US006273216B1

(12) United States Patent
Kocher et al.

(10) Patent No.: US 6,273,216 B1
(45) Date of Patent: Aug. 14, 2001

(54) EMERGENCY RELEASE DEVICE

(75) Inventors: Hans Kocher, Udligenswil; Dietrich Wegener, Weggis, both of (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/407,548

(22) Filed: Sep. 28, 1999

(30) Foreign Application Priority Data

Sep. 28, 1998 (CH) ..... 1970/98

(51) Int. Cl.[7] ..... B66B 5/26
(52) U.S. Cl. ..... 187/377; 187/254; 187/263
(58) Field of Search ..... 187/263, 254, 187/377

(56) References Cited

U.S. PATENT DOCUMENTS

| | | | | |
|---|---|---|---|---|
| 1,315,502 | * | 9/1919 | Huff | 187/263 X |
| 2,262,933 | * | 11/1941 | Heinmiller | 187/263 X |
| 4,592,450 | * | 6/1986 | Schaffer | 187/263 X |
| 5,680,911 | * | 10/1997 | Wang | 187/263 |
| 5,713,433 | * | 2/1998 | Wang | 187/263 |
| 5,819,876 | * | 10/1998 | Chao | 187/263 |
| 5,878,845 | * | 3/1999 | Wang | 187/263 X |
| 5,890,565 | * | 4/1999 | Wang | 187/263 |
| 5,906,252 | * | 5/1999 | Wang | 187/263 |
| 5,971,109 | * | 10/1999 | Aulanko et al. | 187/263 |

FOREIGN PATENT DOCUMENTS

| | | | | |
|---|---|---|---|---|
| 296 15 921 U1 | | 4/1997 | (DE) . | |
| 75371 | * | 2/1953 | (DK) | 187/263 |
| 0 244 030 | | 11/1987 | (EP) . | |
| 1344401 | * | 10/1963 | (FR) | 187/263 |
| 2 583 029 | | 12/1986 | (FR) . | |
| 2 083 292 | | 3/1982 | (GB) . | |
| 5-147854 | * | 2/1953 | (JP) | 187/263 |
| 2-33080 | * | 2/1990 | (JP) | 187/263 |
| 2-270792 | * | 11/1990 | (JP) | 187/263 |
| 3-36185 | * | 2/1991 | (JP) | 187/263 |
| WO 97/05051 | | 2/1997 | (WO) . | |

* cited by examiner

*Primary Examiner*—Eileen D Lillis
*Assistant Examiner*—Thuy V. Tran
(74) *Attorney, Agent, or Firm*—Cohen, Pontani, Lieberman & Pavane

(57) ABSTRACT

An emergency release device for an elevator for persons that includes manually operable drive elements, by which the elevator cage can be moved by way of the elevator drive. The device further includes operating elements by which an operative connection with the elevator drive can be produced and the brake at the elevator drive released. A crank device, a flexible shaft and a switchable crown wheel gear transmission are present as drive elements. The switching or coupling in of the crown wheel gear transmission takes place via a handle with a toggle joint mechanism, a cable pull and an engaging fork. A handle for a remotely actuable brake release by way of a cable pull is present at the crank device.

9 Claims, 1 Drawing Sheet

EMERGENCY RELEASE DEVICE

SUMMARY OF THE INVENTION

1. Field of the Invention

The present invention relates to a manually actuable emergency release device for an elevator in or at a building, with a cage which is guided by means of movable carrier elements by way of a drive pulley. The drive pulley is driven by means of a drive with an elevator motor and a brake and with or without a gear transmission. The emergency release device consists of a device for producing the operative connection with the elevator drive, a manually operable drive element, mechanical transmission means and operating elements for the remote actuation of the operative connection with the elevator drive.

2. Discussion of the Prior Art

Various methods and devices are known for an emergency release of passengers from a cage, which is blocked between two storeys, of an elevator. The present invention is proposed for elevator installations which do not have automatic evacuating travel equipment. In such cases the evacuation or the emergency freeing of the confined passengers is carried out by manual release of the brake and turning of a handwheel or of the driven plate at the elevator motor. Such a manual emergency release, however, presupposes good access to the devices to be operated.

In the case of elevators without an engine room or with an engine room with poor accessibility the direct access to the mentioned devices is not guaranteed. Other methods and devices have to be provided for such cases.

European reference EP 0 244 030 discloses manually actuable release and drive equipment for stairlifts and similar transport equipment for persons. In the case of this equipment a handwheel with coupling sleeve can be pushed on a shaft displaceable in longitudinal direction, wherein two bevel pinions are brought into engagement against spring force and an electrical contact is actuated. The brake at the drive motor of the conveying equipment is released at the same time by the thrust movement of the handwheel shaft.

For use of this device a more or less direct access to the drive of the conveying equipment is required. In order to be able to center the coupling equipment without problems, the handwheel shaft must not be very long. On pushing in of the handwheel shaft, the spring force of the displacement shaft with the primary bevel pinion and the release force of the brake release lever of a brake must be overcome. After the completed engagement, the brake release lever catches in a groove of the handwheel shaft and has to keep this in the engaged setting, otherwise the tooth forces in operation have a constantly uncoupling effect.

As the brake in this setting remains permanently released, a self-locking gear transmission is inevitably necessary. Otherwise a dangerous state contrary to specification would arise, because the load carrier or the elevator cage would automatically set into motion, even with small out-of-balance weights between the load carrier and the counterweight, as soon as the brake is released. The prior known equipment accordingly cannot be used for drives with high efficiency and it is also suitable only for small drives with low drive power, low efficiency and good accessibility.

SUMMARY OF THE INVENTION

The present invention now has the object of creating an improved manually actuable emergency release device which functions reliably in operation and is easy to actuate and economical to produce.

The emergency release device according to the invention is distinguished by the fact that for the manual movement of the elevator cage by way of the elevator drive a simple, mechanical crank device with a preferably flexible shaft as well as a gear transmission, which can be switched in, are present for the operative connection with the elevator drive. As the switchable gearwheel of this gear transmission is displaceable along its axis, thus along the tooth flanks, without change in the depth of engagement, the gearwheel remains safely in engagement during the release operation.

A flexible shaft or a crank rod can be used as mechanical, flexible transmission means for the movement of the elevator cage.

The mounting of a speed reduction gear is advantageous, for example a crown wheel gear transmission, whereby the torque to be applied to the crank device and thus the loading of the connecting elements, for example a flexible shaft, are reduced.

The use of a crown wheel gear transmission as a switchable operative connection has the advantage that the axis of the engageable and disengageable gearwheel does not necessarily need to lie parallel to the axis of the elevator motor, which would in fact require an unfavourable arrangement of the transmission means. Moreover, a torque transmission, which is free of reaction in the axial direction and the engaging, and disengaging of the operative connection with unchanging depth of engagement are thus possible.

The crank device as well as the operating elements are preferably arranged, as a combination, in an actuation niche, wherein the actuation niche can be provided not only anywhere in the shaft wall, but also on the door front on a storey. In the case of an arrangement in the door front, a partial prefabrication at the factory is possible. The operating elements are distinguished by simple construction.

Operating elements adapted to the purpose are constructed in the form of a first, self-restoring handle at the crank device and a handle remaining in drawn setting. The first handle at the crank device can be constructed as a bicycle brake lever and the second handle has a toggle joint mechanism, in order to retain the drawn setting.

The brake at the elevator drive is released, without auxiliary current source, by way of a cable pull by the first handle on actuation thereof and can be blocked again at any time if the elevator cage, in the case of a large weight imbalance, should move too quickly.

The operative connection with the elevator motor of the elevator drive is produced by way of a second cable pull by the second handle, wherein a cylindrical toothed pinion is then axially displaced until it is in engagement in a crown gearwheel. On actuation of this second detenting handle, the operative connection with the lift drive remains in place and does not have to be kept by permanent expenditure of force.

After the produced mechanical coupling between the toothed pinion and the crown wheel, the manipulation of the emergency release device is confined to the application of torque by one hand to the crank and the drawing of the brake release handle by the other hand.

By the crank device manually set into rotation the cage to be evacuated can be set into motion by way of the toothed pinion engaging in the crown on the drive motor shaft, the gear transmission, the drive pulley and the carrier elements.

At least one checking control directly at the emergency release device and further sequential contacts at the elevator drive and in the elevator control secure a risk-free operation of the emergency release device, especially even in the case of unexpected switching back on of the mains voltage during a release manipulation.

By freeing of the brake release handle and tipping over the toggle lever into the initial setting, the elevator is set in readiness for normal operation again after an emergency release, assuming that in the meantime the cause of the breakdown has been removed.

In the case of activated emergency release device a constrainedly actuated safety contact prevents the normal switching-on of the elevator drive.

In the construction with a crank rod, this is variable in length by means of telescopic construction of a part.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
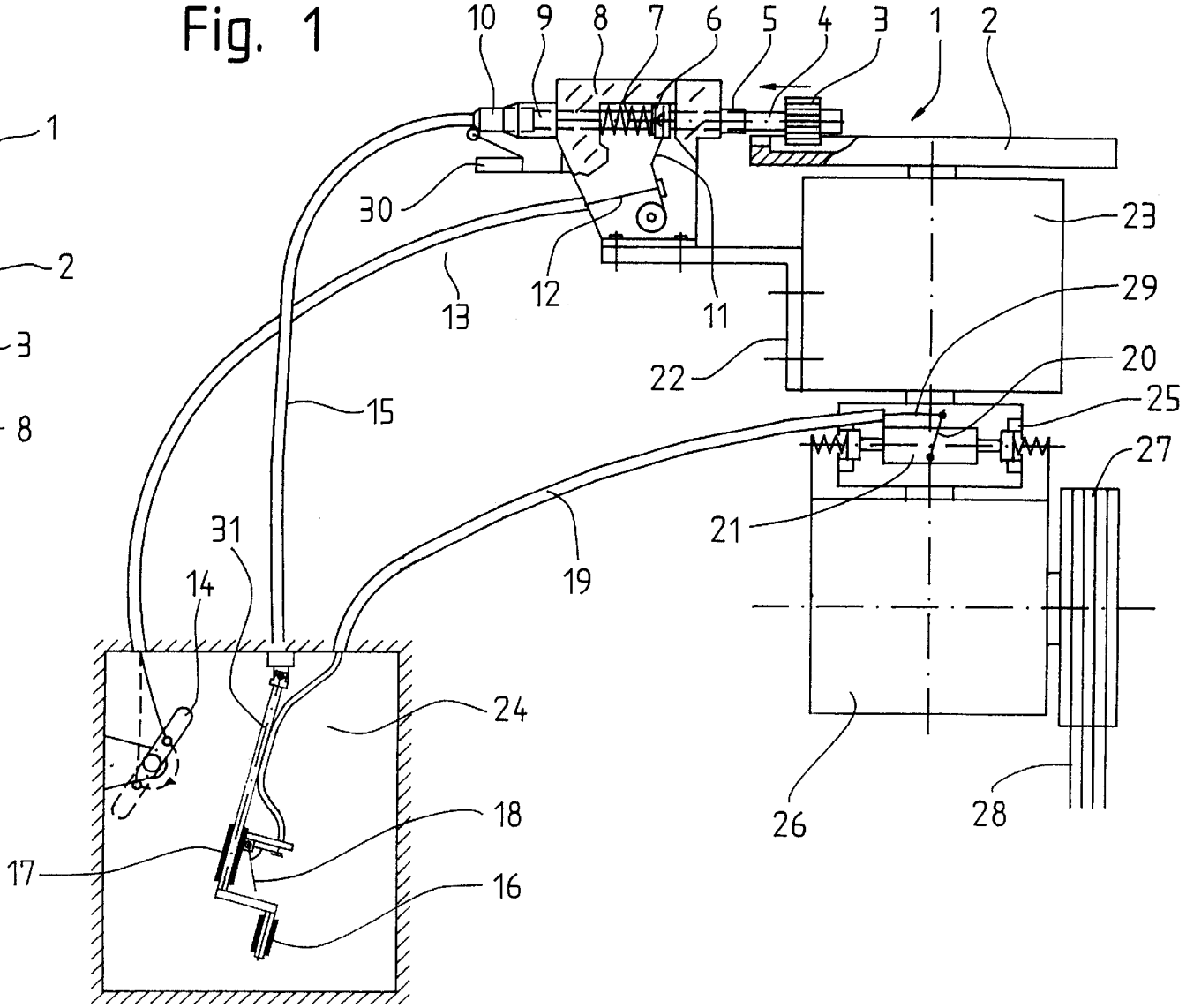
FIG. 1 shows the entirety of the emergency release device according to the invention in partly schematic illustration.

An elevator drive with the emergency release device according to the invention is illustrated in FIG. 1. The elevator drive is arranged in the elevator shaft so as not to be directly accessible and consists of an elevator motor 23, a brake 25 with a brake release magnet 21, a gear transmission 26 and a drive pulley 27. Looped over the pulley 27 are carrier elements 28, which lead to an elevator cable, which is not illustrated, and to a counterweight, which is also not illustrated. A crown wheel 2 is fastened at its free front face to the elevator motor 23 on the elevator motor shaft end. This crown wheel 2 belongs to the subassembly, which stands in direct operative connection with the elevator drive, of the emergency release device, which is laterally fastened to the elevator motor 23 of the elevator drive by way of a mounting part 22 serving as an adapter. The active elements of this subassembly are accommodated in a housing 8. A shaft 4 is led through the housing 8 and is held at the housing outlet on the right in a bearing 5 and ends at the housing outlet on the left in a shaft coupling 9. A cylindrical toothed pinion 3 is seated, as a gearwheel, on the right hand shaft end. Fastened on the otherwise free shaft end of the elevator motor 23 is a crown gearwheel, called the crown wheel 2 in the following, and forms, together with the toothed pinion 3, a crown wheel gear transmission 1 when the toothed pinion 3 stands in engagement with the crown wheel 2. For this purpose the shaft 4, for the production of the operative connection with the elevator drive, is mounted in the housing 8 to be longitudinally displaceable along its axis together with the toothed pinion 3 and is held by a spring 7, during normal operation of the elevator, in the uncoupled setting, as illustrated in FIG. 1. Present in the housing 8, which is shown partially cut away, is an engaging fork 11 which is pivotably mounted at the lower end and bears by a forked end against a pressure ring 6 which is present, directly to the right near the spring 7, to be longitudinally displaceable. The longitudinal displacing of the shaft 4 is effected by a pull wire 12 of a Bowden pull 13. The pull wire 12 is operatively connected with the engaging fork 11 so that an actuation of the engaging fork 11 draws the shaft 4 and together therewith the toothed pinion 3 to the left into engagement with the crown wheel 2 by way of the pressure ring 6 against the force of the spring 7. In this state the crown wheel gear transmission 1 is functionally ready. In the shaft coupling 9, the rigid shaft 4 is connected with a flexible shaft 15 in rotationally fast manner, wherein a switching sleeve 10 displacing with the shaft 4 constrainedly actuates a safety switch 30 during the coupling process.

The actuating parts of the emergency release device are accommodated in an externally accessible actuation niche 24. The actuation niche 24 can in principle be disposed anywhere in the building in the proximity of the elevator. The actuation niche 24 is advantageously closed by a flap, a door or a slide and is accessible for informed persons. The distance to the elevator drive is limited only by the length, which it is practicable to execute, of the flexible mechanical transmission means. In the present case of use, distances of, for example, two to three metres are concerned.

A handle 14 and a hand crank 16 are disposed in the actuation niche 24. The tipping over of the handle 14 effects, by way the cable pull 13 with a cable wire 12, the uncoupling of the crown wheel gear transmission 1. Thanks to the toggle joint mechanism of the handle 14 this remains in the drawn setting. A handle 18 in the form, by way of example, of a bicycle brake lever is present at the hand crank 16 on a handle sleeve 17. On drawing of the handle 18 the actuation takes place, by way of a cable pull 19 with a pull wire 29, of a brake lever 20 at the brake magnet 21 and thus a release of the brake 25 of the elevator drive. Through the rotation of the handcrank 16 the elevator motor can by way of the crown wheel gear transmission 1, and thus the elevator cage by way of the gear transmission 26, the drive pulley 27 and the carrier elements 28, be moved in the desired direction. The movement is in that direction for which the smaller torque is needed. A simple mechanical storey indicator device, which is not illustrated, informs the person at the crank handle 16 about the cage position. This can be executed in the form of, for example, markings at the carrier elements, which presupposes a visual connection therewith.

Figure 2:
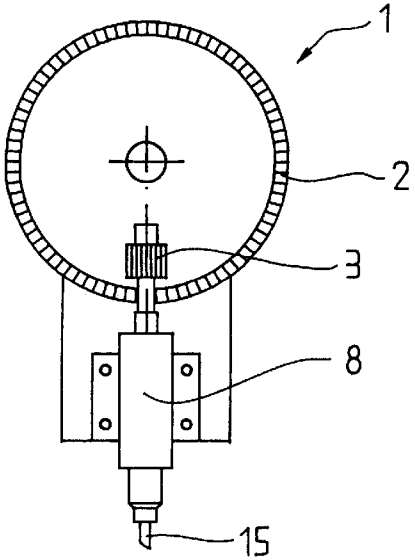
FIG. 2 shows a plan view of the gear transmission with toothed pinion and crown wheel.

FIG. 2 shows the crown wheel gear transmission in plan view with the toothed crown of the crown wheel 2 and the cylindrical toothed pinion 3. The teeth of the crown wheel 2 and the teeth of the toothed pinion 3 have a shape favorable for mutual engagement. The teeth of the crown wheel 2 are for this purpose formed to taper somewhat to a point in the direction towards the center and those of the toothed pinion 3 in the opposite direction. The probability of a mechanical jamming by hitting together of tooth cross-section surfaces during engagement of the toothed pinion 3 in the tooth crown of the crown wheel 2 is thereby extremely small.

If the placement of the actuation niche 24 in the shaft wall is planned, an opening with closable access door must be provided at an appropriate location. Preferably, however, the actuation niche 24 is accommodated in the door front near a shaft door. In this mode of placement, a door front with a box arranged at the rear side and a closure door at the front side can be provided and prefabricated already at the factory.

In the case of use of an articulated crank rod 31, this can be constructed to be telescopically extensible for a more convenient manipulation. Equally, the end member with the crank of a flexible shaft can, for the same purpose, preferably be withdrawn a bit out of the actuation niche 24.

Instead of a crown wheel gear transmission 1 there can be used, with appropriate adaptations, also a spur wheel gear transmission or an internally toothed gear transmission. In these embodiments the shaft with the toothed pinion extends parallel to the shaft of the elevator motor and similarly engages by longitudinal displacement. These forms of construction are suitable for elevators in which space is available in the axial direction of the motor, for example in the case of flat motors or motors lying flat.

The invention is not limited by the embodiments described above which are presented as examples only but can be modified in various ways within the scope of protection defined by the appended patent claims.

We claim:

1. A manually actuable emergency release device for an elevator with a cage which is guided in a shaft and driven by means of movable carrier elements by way of a drive pulley, the drive pulley being driven by a drive with an electric motor having a shaft and a brake, the emergency release device comprising:

a manually operable drive element operatively arranged so as to produce a required motor force for an evacuation movement of the elevator;

mechanical transmission means for operatively connecting the manually operable drive element to the shaft of the elevator motor, the mechanical transmission means including a device operative to selectively engage and disengage the connection between the manually operable drive element and the shaft;

operating elements for remotely engaging and disengaging the operative connection; and operating means for remotely engaging and disengaging the brake of the elevator motor, the device operative to selectively engage and disengage the connection between the manually operable drive element and the shaft of the elevator motor including a gear wheel transmission having two gear wheels with substantially orthogonally intersecting axes, a first of the gear wheels being mountable on the shaft of the elevator motor and a second of the gear wheels being linked with the manually operable drive element and being engagable and disengagable with the first gear wheel by displacement along the second gear wheel axis the gear wheels having tooth characteristics which allow axial displacement of the second gear wheel along its axis without a change in depth of engagement of the gear wheels.

2. An emergency release device according to claim 1, wherein said gear wheel transmission is a crown wheel gear transmission, the first gear wheel being a crown wheel and the second gear wheel being a driving pinion, the tooth characteristics of the crown wheel being configured so as to allow the axial displacement of the driving pinion.

3. An emergency release device according to claim 1, wherein the manually operable drive element is a crank device.

4. An emergency release device according to claim 3, wherein the crank device includes a crank rod, the operating means for remotely controlling engagement and disengagement of the brake of the elevator motor including a self-restoring handle attached to the crank rod of the crank device and a bowden pull attached between the self-restoring handle and a brake release device of the brake of the elevator motor.

5. An emergency release device according to claim 3, wherein the crank device has an articulated crank rod.

6. An emergency release device according to claim 1, wherein the mechanical transmission means includes a flexible shaft.

7. An emergency release device according to claim 1, wherein the operating means for remotely controlling engagement and disengagement of the operative connection includes a toggle joint handle and a bowden pull connected to the handle.

8. An emergency release device according to claim 7, wherein the crank device, the operating means for remotely controlling engagement and disengagement of the operative connection and the operating means for remotely controlling engagement and disengagement of the brake are arranged in an actuation niche provided in one of the elevator shaft and a door front.

9. An emergency release device according to claim 1, and further comprising sensor means for detecting position of the axially displaceable second gear wheel of the gear wheel transmission.

* * * * *